US006347676B1

(12) United States Patent
Vuyk, Jr.

(10) Patent No.: US 6,347,676 B1
(45) Date of Patent: Feb. 19, 2002

(54) TOOTH TYPE DRILL BIT WITH SECONDARY CUTTING ELEMENTS AND STRESS REDUCING TOOTH GEOMETRY

(75) Inventor: Adrian Vuyk, Jr., Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/547,525

(22) Filed: Apr. 12, 2000

(51) Int. Cl.[7] ..... E21B 10/16
(52) U.S. Cl. ..... 175/331; 175/374
(58) Field of Search ..... 175/331, 336, 175/341, 374

(56) References Cited

U.S. PATENT DOCUMENTS

| | | | | |
|---|---|---|---|---|
| 1,885,085 A | | 10/1932 | Dalzen | |
| 1,957,532 A | | 5/1934 | Flynn | |
| 2,107,788 A | | 2/1938 | Hall | |
| 2,244,617 A | | 6/1941 | Hannum | |
| 2,907,551 A | | 10/1959 | Peter | |
| 3,003,370 A | | 10/1961 | Coulter, Jr. | |
| 3,104,726 A | * | 9/1963 | Davis | 175/331 |
| 3,223,188 A | | 12/1965 | Coulter, Jr. et al. | |
| 3,266,342 A | | 8/1966 | Coulter, Jr. et al. | |
| 3,280,926 A | | 10/1966 | Graham et al. | |
| 3,412,817 A | | 11/1968 | Reichmuth | |
| 3,946,820 A | | 3/1976 | Knapp | |
| 4,554,130 A | | 11/1985 | Ecer | |
| 4,562,892 A | | 1/1986 | Ecer | |
| 4,592,252 A | | 6/1986 | Ecer | |
| 4,630,692 A | | 12/1986 | Ecer | |
| 5,032,352 A | | 7/1991 | Meeks et al. | |
| 5,431,239 A | * | 7/1995 | Tibbitts et al. | 175/428 |
| 5,653,299 A | | 8/1997 | Sreshta et al. | |
| 5,676,214 A | | 10/1997 | Pearce et al. | |
| 5,868,213 A | * | 2/1999 | Cisneros et al. | 175/331 |

* cited by examiner

*Primary Examiner*—William Neuder
(74) *Attorney, Agent, or Firm*—Jeffrey E. Daly

(57) ABSTRACT

Disclosed is a tooth type rolling cutter earth boring drill bit with secondary cutting elements on the tooth surfaces. The secondary cutting elements provide additional, relatively sharp edges that help cut hard rock. The teeth also have convex radiused buttresses at their bases to reduce the stresses the teeth experience when drilling through extremely hard rock. This allows the tooth bit to survive the high loads encountered when drilling hard, tough rock formations, without breaking the teeth. The combination of teeth with secondary cutting elements and convex radiused buttresses at their base provide a tooth type rotary drill bit that has superior resistance to wear and breakage when drilling through hard, tough rock without significantly reducing the drilling rate of penetration when drilling through soft rock.

20 Claims, 2 Drawing Sheets

TOOTH TYPE DRILL BIT WITH SECONDARY CUTTING ELEMENTS AND STRESS REDUCING TOOTH GEOMETRY

BACKGROUND OF THE INVENTION

1. Field of the Invention

The present invention relates to earth boring bits used in the retrieval of oil, natural gas, and other earth minerals. In particular, the invention is a new rolling cutter drill bit with a tooth structure having integral secondary cutting elements and a reduced stress tooth geometry.

2. Description of the Related Art

Earth boring bits used for the recovery of petroleum and other minerals from the earth are generally of either the fixed cutter type or rolling cutter type. A fixed cutter drill bit has a plurality of cutting edges that are pushed into and dragged through the earth. This type of bit removes the earth primarily by shearing and scraping.

Rolling cutter drill bits (also known as rock bits) have cutting teeth or cutting inserts arranged upon one or more rotating cutters. Typically, the bit body has three cantilevered bearing spindles with frusto-conically shaped rolling cutters arranged on them. When the bit body is rotated and weight is applied, the teeth on the cutters engage the earth causing the rolling cutters to rotate. As the cutters rotate, the teeth are sequentially pushed into the earth, effecting a drilling action.

There are two broad classifications of rolling cutter drill bits—insert bits and tooth bits. The distinction between these bit types is in the way in which the cutting teeth are formed on the rolling cutter. Insert bits typically have cylindrical tungsten carbide cutting elements interference fitted into holes drilled into the cutters. These bits typically drill very hard and tough rock formations where the durability of the superhard cutting elements is required for good bit life and performance. The limited protrusion, blunt cutting edge, and narrow width of the cutting inserts, however, limit how fast the bit can drill.

On a tooth type rock bit, the cutting teeth are formed out of the same steel material as the frusto-conical roller body. Tooth type rock bits are generally used in the softer drilling applications where the long, sharp teeth allow deep penetration into the formation. The deep penetration into the earth combined with a wide tooth profile provide high drilling rates of penetration for tooth bits in the softer formations. The relatively slender teeth are designed primarily to drill the softer formations. Encounters with hard, tough formations often cause very rapid wear and/or breakage of the teeth.

In one commonly used process for manufacturing tooth type bits, the teeth and cutter body are machined from a blank of forged steel. Multiple machine milling passes are required to remove all the material from the blank to form the teeth and other surface features.

After machining, portions of the teeth are provided with hard, wear and abrasion resistant coatings to slow the degradation (or dulling) of the teeth as the earth is being drilled. On most tooth type bits, this coating is applied to the teeth with a weld process. After welding the hardmetal coatings on the teeth, portions of the cutters are carburized, and the whole cutter is hardened in a heat treatment process. The bearing surfaces inside the cutter are then finished machined. Finally, the cutters are assembled onto the bit bodies with one of a number of methods well known in the rock bit manufacturing industry.

Numerous U.S. Patents, such as: U.S. Pat. Nos. 3,946,820; 3,412,817; 3,401,926; 3,266,342; 3,223,188; 3,003,370; 2,097,551; 1,885,085; 1,957,532; 2,107,788; 2,244,617 (all herein incorporated by reference), show a variety of designs for tooth bit teeth and/or tooth bit machining process.

Another method for manufacture of tooth type rock bit cutters is rapid solid state densification powdered metallurgy (RSSDPM). The RSSDPM process and products made by it are shown and described in U.S. Pat. Nos. 4,554,130; 4,562,892; 4,592,252; 4,630,692; 5,032,352; 5,653,299 and 5,676,214 all herein incorporated by reference. RSSDPM has been proven a commercially viable means of forming tooth type bit cutters. One advantage to rapid solid state densification is the teeth can be formed with an integral hard coating as part of the manufacturing process. This type of hard coating eliminates the hardfacing welding step required in machined tooth cutters and produces a very smooth surface on the tooth. Integral formation of the hard coating improves the performance of tooth bits and the increased percentage of tungsten carbide available at the tooth surface increases the wear resistance.

The RSSDPM process also allows greater flexibility in tooth bit cutter design. For instance, in U.S. Pat. No. 5,767,214, the RSSDPM process allows a cutter design with channels formed in the gage face and angled teeth that would at best be impractical to make with a machining process. As noted in the prior art, the RSSDPM process produces a tooth type bit cutter with numerous properties that are separate and distinct from all other known process.

The drilling applications for tooth type bits have been limited by the inability of these bits to drill hard rock. In most areas of the earth, the sub-surface rock formations are layered. It is very common for an extremely hard layer of rock to be adjacent to a soft layer of rock in the earth. In the drilling industry, it is desirable to drill through both layers as quickly as possible. Since it is time consuming (and therefore expensive) to change the rock bit each time a new layer of rock is encountered, a bit chosen to drill both types of formations is often running under less than optimum drilling conditions.

In the cases where the majority of the drilling is hard rock, the insert bit will simply drill slower when drilling in the soft layers. However, when the majority of the layers are soft rock, a tooth bit can be destroyed by a relatively thin layer of hard, tough rock. The driller then faces a dilemma. If he uses an insert type bit he can easily drill through the hard formations, but he will sacrifice drilling speed and drive up the cost. If the driller uses a tooth type bit, he will get economical, high drilling speeds but he risks destruction of the bit and the downtime required to replace it.

Although advances in hardfacing materials and methods, and the advent of RSSDPM processing have made tooth type bits more durable in recent years, the problem remains. There is a need in the drilling industry for a tooth type bit that has the broad, long cutting teeth required for optimum drilling performance in soft formations that can also survive short intervals of extremely hard, tough rock drilling.

BRIEF SUMMARY OF THE INVENTION

The present invention is a tooth type drill bit with secondary cutting elements on the tooth surfaces. The secondary cutting elements provide additional, relatively sharp edges that help cut hard rock.

The teeth also have convex radiused buttresses at their bases to reduce the stresses the teeth experience when drilling through extremely hard rock. This allows the tooth bit to survive the high loads encountered when drilling hard, tough rock formations, without breaking the teeth.

The combination of teeth with secondary cutting elements and convex radiused buttresses at their base provide a tooth type bit that has superior resistance to wear and breakage when drilling through hard, tough rock without significantly reducing the drilling rate of penetration when drilling through soft rock.

In its broadest sense, the invention is a tooth type rolling cutter drill bit with a plurality of rolling cutters mounted on bearing spindles. At least one generally wedge-shaped cutting tooth with a top, sides, and a base is formed on one of the rolling cutters. The sides of the tooth comprise a pair of substantially flat flanks and a pair of curved end surfaces. The flanks are joined at one end to form an elongated cutting edge with a given minimum thickness at the top of the tooth. A buttress is formed about the base of the tooth. The flanks and sides of the tooth smoothly blend into the buttress. The buttresses and at least one of the curved end surfaces of the tooth each forms a convex surface.

A secondary cutting element may be formed on a flank of the tooth between the elongated cutting edge and the buttress. The secondary cutting element protrudes from the flank and has a secondary cutting edge with a top end adjacent to, but not touching, the elongated cutting edge of the tooth and a bottom end that is adjacent to the buttress. The secondary cutting edge is aligned generally perpendicular to the elongated cutting edge of the tooth. The maximum protrusion of the secondary cutting element is no greater than the thickness of the elongated cutting edge of the tooth. The bottom end of the secondary cutting element may be wider than its top end. The protrusion of the secondary cutting edge may be greater at its bottom end than its top end. The secondary cutting element is formed of a hard, wear and erosion resistant material, preferably tungsten carbide in an iron alloy matrix.

All, or a portion of the tooth, may be formed with a hard, wear and erosion resistant surface, preferably tungsten carbide in an iron alloy matrix - in an RSSDPM process.

DETAILED DESCRIPTION OF THE INVENTION AND THE PREFERRED EMBODIMENT

Figure 1:
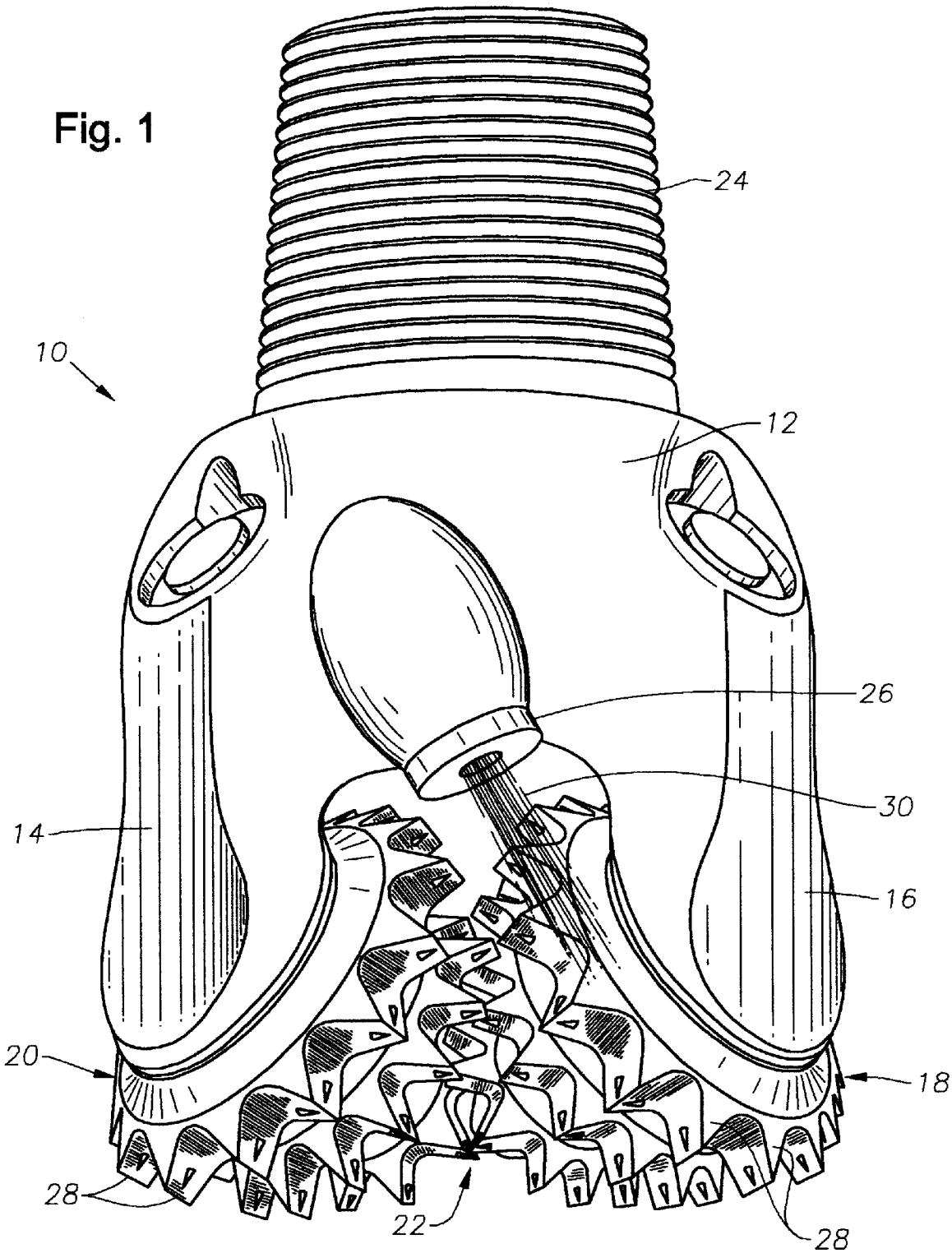
FIG. 1 is a perspective view of a tooth type rock bit of the present invention.

A typical tooth type bit is shown as numeral 10 of FIG. 1. Typically, tooth bits have a body 12 with three legs 14, 16 (only two are shown). Upon each leg is mounted a rolling cutter 18, 20, 22. During operation, the bit 10 is secured to drill pipe (not shown) by threads 24. The drill pipe is rotated at the surface and drilling fluid is pumped to the bit 10 and exits through one or more nozzles 26. The weight of the drilling string forces the cutting teeth 28 of the cutters 18, 20, 22 into the earth, and, as the bit 10 is rotated, the earth causes the cutters 18, 20, 22 to rotate upon the legs 14, 16 effecting a drilling action. The drilling fluid 30 exiting the nozzles 26 flush away the earth removed by the cutters 18, 20, 22 and can remove cuttings which often adhere to the cutters 18, 20, 22.

Figure 2:
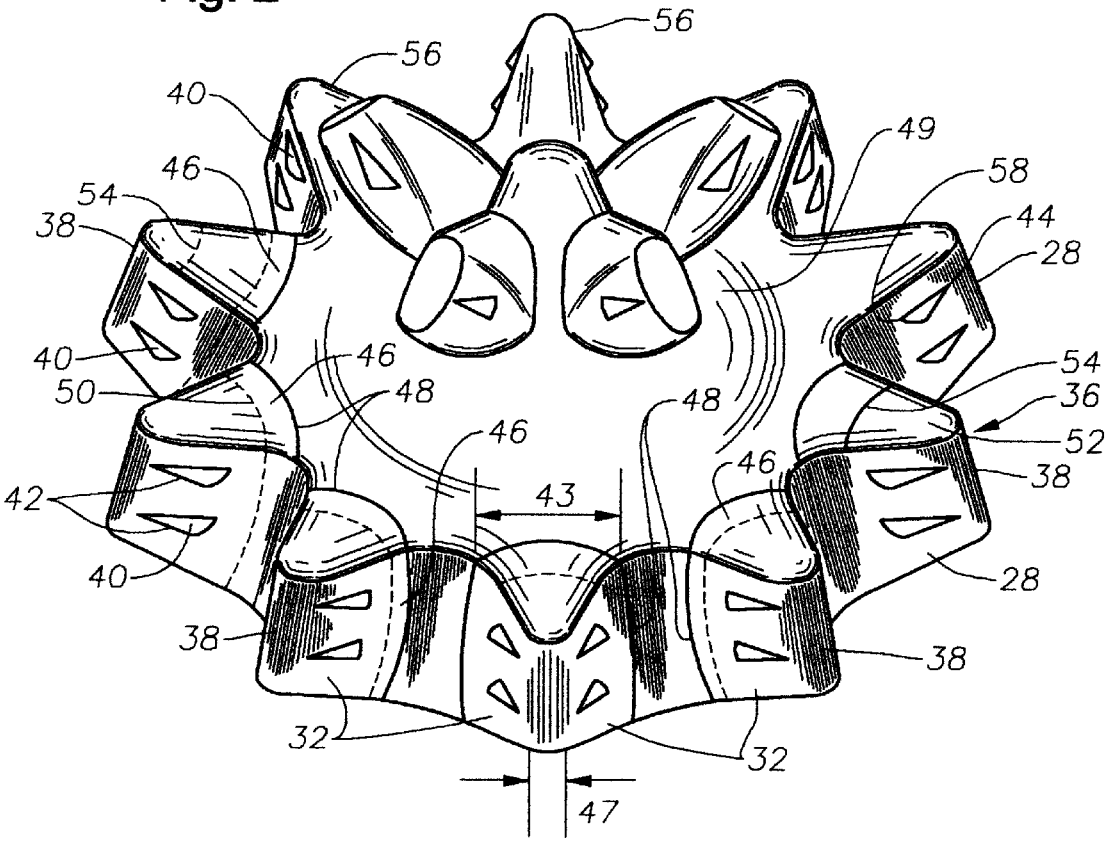
FIG. 2 is a perspective view of a typical cutter of a tooth type rock bit of the preferred embodiment.
Figure 3:
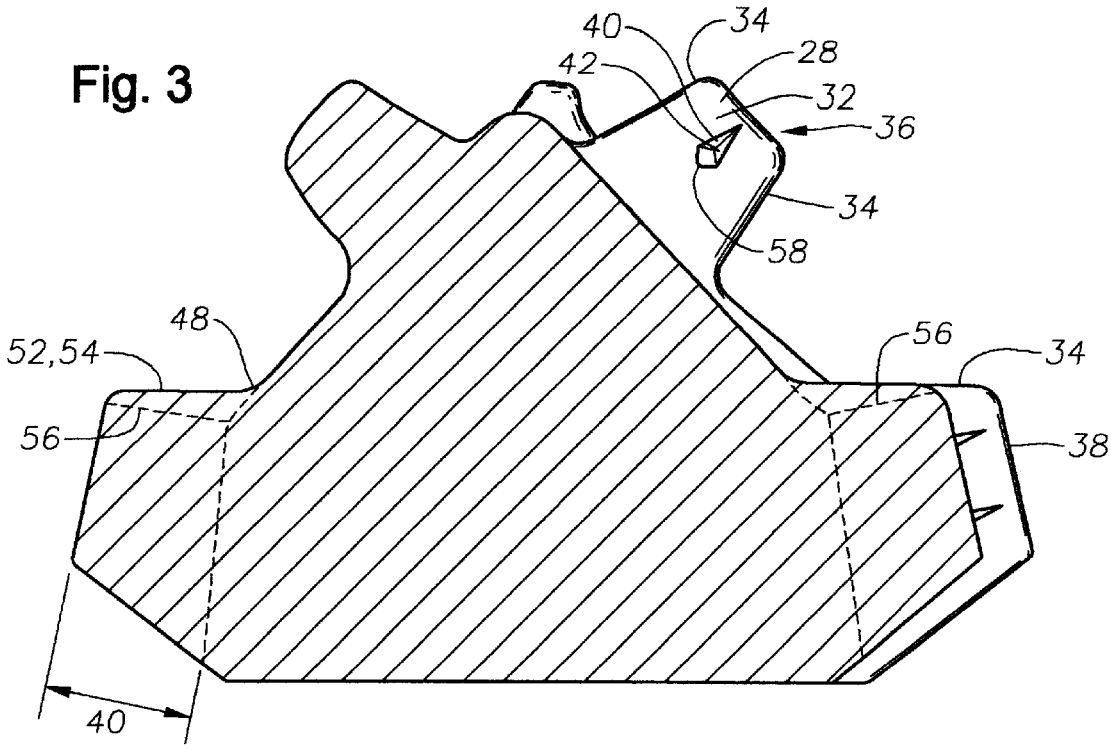
FIG. 3 is a cut away perspective view of the cutter of the tooth type rock bit shown in FIG. 2.

As shown in FIGS. 1–3 the teeth 28 are generally wedge shaped with a pair of relatively flat flanks 32 and a pair of curved end surfaces 34. The two flanks 32 are joined at the top 36 of the tooth 28 to form an elongated cutting edge 38. As the cutters 18, 20, 22 rotate during drilling, the elongated cutting edge 38 is forced into the earth formation. The 'sharper' a tooth is, the deeper it will penetrate the formation at a given load. The sharpness of a tooth is determined by its height 40, its thickness 43 at the base of the tooth, the width 47 of the elongated cutting edge 38 and the length of the elongated cutting edge 38. It is generally expected that a sharp tooth 28 will penetrate about three-fourths to seven-eighths of its height into the formation at standard bit loads.

By design, the rolling cutters do not allow a true rolling action of the teeth 28 when drilling. Therefore, each tooth 28 is scraped, or plowed a short distance through the earth formation as it is penetrating the earth. This plowing action greatly increases the bit's drilling rate of penetration (ROP) into the earth. Generally, the longer the elongated cutting edge 38, the greater the ROP increase due to the plowing action.

The combination of the tooth's 28 sharpness and the tooth's 28 plowing action are what makes a tooth type bit's ROP ten or more times faster than an insert type bit when drilling soft rock. Unfortunately, this same combination has historically lead to bit failure in a tooth type bit when the earth formation changes from soft rock to hard and/or tough rock.

The present invention has a combination of novel features which allow a tooth type bit 10 to survive encounters with hard and/or tough rock. A tooth bit 10 drilling hard rock will not penetrate very deeply into the rock. The reduced penetration dramatically decreases the ROP of the bit. Knowing the trade-off, a driller will typically increase the weight on bit (WOB) in an attempt to drill as much of the interval as economically as possible. Prior to the present invention, the resulting increased tooth penetration would provide only modest ROP gain, and would cause rapid tooth degradation.

In the preferred embodiment of the present invention, a secondary cutting element 40 arranged on a flank 32 of a tooth 28 engages and penetrates the hard rock formation with a secondary cutting edge 42. A plurality of secondary cutting elements 40 on teeth 28 significantly increase the teeth's ability to drill the hard rock. Each secondary cutting edge 42 is arranged generally perpendicular to the elongated cutting edge 38 of the tooth 28. The secondary cutting edge 42 has a top end 44 adjacent to, but not touching, the elongated cutting edge 38 of the tooth 28. The arrangement allows the secondary cutting edge 42 to cut more effectively into the hard rock, because its cutting edge is normal to the plowing action on the tooth 28. Consequently, the secondary cutting edge 42 on the tooth 28 is able to chip hard rock with less force.

The protrusion of the secondary cutting edge 42 is limited to the thickness 47 of the elongated cutting edge 38. Limiting the protrusion improves the durability of the secondary cutting edge 42 without significantly reducing the sharpness of the tooth 28. In addition, since the top end 44 of the secondary cutting edge 42 does not touch the elongated cutting edge 38 of the tooth 28, it is protected from the impact loading normally experienced by the elongated cutting edge 38. This also enhances the durability of the secondary cutting edge 42.

Each tooth 28 also has a buttress 46 about its base. The outer edge 48 of the buttress 46 is approximately as far distant from the base of the tooth as the top 50 of the buttress 46 is from the surface of the cutter shell 49. In addition to the buttress 46, the finished edges of each tooth 28 have a radius blended such that no comer can be defined anywhere on the tooth 28.

Finally, at least one of the curved end surfaces 52 of the tooth 28 is provided with a convex surface 54. The buttresses 46 and the curved end surface 52 of the tooth blend to form a convex surface. The amount of curvature in the end surface 52 is shown in the cross section view of the cutter 18 in FIG. 3. The edge 56 of the tooth where the flank 32 and the curved end surface 52 intersect is shown as a dashed line. The combination of buttresses 46 and curved end surfaces 52 add an unexpected amount of strength to the tooth 28 without reducing the sharpness of the tooth 28. In addition, the lower end 58 of the secondary cutting edge 42 may be arranged so that it does not touch the edge of the buttress 46. In the preferred embodiment, the secondary cutting edge 42 is formed fully on the flank 32 of the tooth 28. This construction reduces stresses near the critical base portion of the tooth 28. During the intervals the bit is drilling the hard rock, tooth breakage in a bit of the present invention is greatly reduced compared to prior art tooth bits due to these stress reducing constructions.

Whereas the present invention has been described in particular relation to the drawings attached hereto, it should be understood that other and further modifications apart from those shown or suggested herein, may be made within the scope and spirit of the present invention.

What is claimed is:

1. A tooth type rolling cutter drill bit having a bit body, a plurality of depending legs mounted on the bit body, and a rolling cutter mounted on each depending leg, each rolling cutter having a cutter shell surface, and a plurality of wedge-shaped cutting teeth formed on the cutter shell surface, at least one of the teeth having a top, a plurality of sides, and a base, the sides of the tooth comprising a pair of substantially flat flanks and a pair of curved end surfaces, the substantially flat flanks join at the top of the tooth to form an elongated cutting edge, a buttress is formed about the base of the tooth, the flanks and sides of the tooth blend smoothly into the buttress, wherein the buttress and at least one of the curved end surfaces of the tooth form a convex surface at the base of the tooth and wherein at least one secondary cutting element is formed on at least one of the flanks of the tooth between the elongated cutting edge and the buttress, the secondary cutting element comprising a secondary cutting edge with a protrusion extending from the flank of the tooth and having a top end adjacent to, but not touching, the elongated cutting edge of the tooth and a bottom end that is adjacent to the buttress, wherein the secondary cutting edge is aligned generally perpendicular to the elongated cutting edge of the tooth.

2. The tooth type rolling cutter drill bit of claim 1 wherein the buttress has an outer edge and a top wherein the outer edge of the buttress is substantially as far distant from the base of the tooth as the top of the buttress is from the cutter shelf surface.

3. The tooth type rolling cutter drill bit of claim 1 wherein the plurality of sides join at a plurality of edges, including the elongated cutting edge, that all have radii blended such that no corner can be defined anywhere on the tooth.

4. The tooth type rolling cutter drill bit of claim 1 wherein the elongated cutting edge has a thickness and the protrusion of the secondary cutting element is no greater than the thickness of the elongated cutting edge.

5. The tooth type rolling cutter drill bit of claim 1 wherein the bottom end of the secondary cutting element is wider than the top end of the secondary cutting element.

6. The tooth type rolling cutter drill bit of claim 1 wherein the protrusion of the secondary cutting edge is greater at the bottom end of the secondary cutting element than at the top end of the secondary cutting element.

7. The tooth type rolling cutter drill bit of claim 1 wherein the secondary cutting element is formed of a hard, wear and erosion resistant material.

8. The tooth type rolling cutter drill bit of claim 7 wherein the hard, wear and erosion resistant material is tungsten carbide in an iron alloy matrix.

9. The tooth type rolling cutter drill bit of claim 1 wherein a portion of a flank of the tooth is formed with a hard, wear and erosion resistant surface.

10. The tooth type rolling cutter drill bit of claim 9 wherein the hard, wear and erosion resistant surface is tungsten carbide in an iron alloy matrix.

11. A tooth type rolling cutter drill bit having a bit body, a plurality of depending legs mounted on the bit body, and a rolling cutter mounted on each depending leg, each rolling cutter having a cutter shell surface, and a plurality of wedge-shaped cutting teeth formed on the cutter shell surface, at least one of the teeth having a top, a plurality of sides, and a base, the sides of the tooth comprising a pair of substantially flat flanks and a pair of curved end surfaces, the substantially flat flanks join at the top of the tooth to form an elongated cutting edge, a buttress is formed about the base of the tooth, the flanks and sides of the tooth blend smoothly into the buttress, at least one secondary cutting element formed on a flank of the tooth between the elongated cutting edge and the buttress, the secondary cutting element comprising a secondary cutting edge with a protrusion extending from the flank of the tooth and having a top end adjacent to, but not touching, the elongated cutting edge of the tooth and a bottom end that is adjacent to the buttress, wherein the secondary cutting edge is aligned generally perpendicular to the elongated cutting edge of the tooth.

12. The tooth type rolling cutter drill bit of claim 11 wherein the buttress has an outer edge and a top wherein the outer edge of the buttress is substantially as far distant from the base of the tooth as the top of the buttress is from the cutter shell surface.

13. The tooth type rolling cutter drill bit of claim 11 wherein the elongated cutting edge has a thickness and the protrusion of the secondary cutting element is no greater than the thickness of the elongated cutting edge.

14. The tooth type rolling cutter drill bit of claim 11 wherein the bottom end of the secondary cutting element is wider than the top end of the secondary cutting element.

15. The tooth type rolling cutter drill bit of claim 11 wherein the protrusion of the secondary cutting edge is greater at the bottom end of the secondary cutting element than at the top end of the secondary cutting element.

16. The tooth type rolling cutter drill bit of claim 11 wherein the secondary cutting element is formed of a hard, wear and erosion resistant material.

17. The tooth type rolling cutter drill bit of claim 16 wherein the hard, wear and erosion resistant material is tungsten carbide in an iron alloy matrix.

18. The tooth type rolling cutter drill bit of claim 11 wherein a portion of a flank of the tooth is formed with a hard, wear and erosion resistant surface.

19. The tooth type rolling cutter drill bit of claim 18 wherein the hard, wear and erosion resistant surface is tungsten carbide in an iron alloy matrix.

20. The tooth type rolling cutter drill bit of claim 11 wherein the plurality of sides join at a plurality of edges that all have radii blended such that no corner can be defined anywhere on the tooth.

* * * * *